US010221842B2

(12) United States Patent
Lilie et al.

(10) Patent No.: US 10,221,842 B2
(45) Date of Patent: Mar. 5, 2019

(54) LINEAR COMPRESSOR

(71) Applicant: Whirlpool S.A., São Paulo-Sp (BR)

(72) Inventors: Dietmar Erich Bernhard Lilie, Joinville-Sc (BR); Paulo Rogerio Carrara Couto, Joinville-Sc (BR); Celso Kenzo Takemori, Joinville-Sc (BR); Egidio Berwanger, Joinville-Sc (BR)

(73) Assignee: Whirlpool S.A., Sao Paulo-SP (BR)

( * ) Notice: Subject to any disclaimer, the term of this patent is extended or adjusted under 35 U.S.C. 154(b) by 380 days.

(21) Appl. No.: 14/630,084

(22) Filed: Feb. 24, 2015

(65) Prior Publication Data

US 2015/0167658 A1 Jun. 18, 2015

Related U.S. Application Data

(63) Continuation-in-part of application No. 13/382,440, filed as application No. PCT/BR2010/000224 on Jul. 6, 2010, now Pat. No. 8,998,589.

(30) Foreign Application Priority Data

Jul. 8, 2009 (BR) ..... 0902557-0

(51) Int. Cl.
*F04B 35/04* (2006.01)
*F04B 39/00* (2006.01)
(Continued)

(52) U.S. Cl.
CPC ..... *F04B 35/045* (2013.01); *F04B 39/0005* (2013.01); *F04B 39/0027* (2013.01);
(Continued)

(58) Field of Classification Search
CPC ..... F04B 35/045; F04B 17/04–17/044; F04B 39/044; F04B 39/0027; F04B 39/0005; F04B 53/146–53/147; F04B 53/162
(Continued)

(56) References Cited

U.S. PATENT DOCUMENTS 1,789,694 A 1/1931 Beman
1,996,160 A 4/1935 Konig
(Continued)

FOREIGN PATENT DOCUMENTS

WO 02090773 A1 11/2002
WO 2006069884 A1 7/2006
WO 07118295 A1 10/2007

OTHER PUBLICATIONS

International Search Report dated Oct. 13, 2010, International Application No. PCT/BR2010/000224.

*Primary Examiner* — Alexander B Comley
(74) *Attorney, Agent, or Firm* — Harrington & Smith

(57) ABSTRACT

The linear compressor comprises a shell (10) which affixes a cylinder (20) defining a compression chamber (21) housing a piston (30); a linear electric motor (40) having a fixed part (41) and a reciprocating movable part (42); an actuating means (50) driven by the movable part (42); an elastic means (60*a*) coupling the actuating means (50) to the piston (30), so that they are reciprocated in phase opposition. A supporting elastic means (70) connects the actuating means (50) to the shell (10) and presents a radial stiffness for supporting the lateral loads actuating on said movable part (42) and actuating means (50), and for minimizing the axial misalignments between the movable part (42) and the fixed part (41) of the linear electric motor (40), the supporting elastic means (70) presenting a minimum axial stiffness for allowing the displacement of both the piston (30) and the actuating means (50).

1 Claim, 12 Drawing Sheets

(51) Int. Cl.
*F04B 53/14* (2006.01)
*F04B 53/16* (2006.01)

(52) U.S. Cl.
CPC ..... *F04B 39/0044* (2013.01); *F04B 53/146* (2013.01); *F04B 53/147* (2013.01); *F04B 53/162* (2013.01)

(58) Field of Classification Search
USPC ..... 417/363, 415–417, 470–471; 92/130 D, 92/137, 163, 256; 310/12.04, 15–35
See application file for complete search history.

(56) References Cited

U.S. PATENT DOCUMENTS

| | | | | |
|---|---|---|---|---|
| 2,954,917 | A | 10/1960 | Bayer | |
| 3,490,684 | A | 1/1970 | Rietveld | |
| 3,947,155 | A | 3/1976 | Bidol | |
| 5,525,845 | A | 6/1996 | Beale et al. | |
| 5,779,455 | A | 7/1998 | Steiger | |
| 5,980,211 | A | 11/1999 | Tojo et al. | |
| 6,127,750 | A | 10/2000 | Dadd | |
| 6,129,527 | A | 10/2000 | Donahoe et al. | |
| 6,273,688 | B1 * | 8/2001 | Kawahara | F04B 35/045 417/363 |
| 6,540,490 | B1 | 4/2003 | Lilie | |
| 6,742,998 | B2 * | 6/2004 | Kawahara | F04B 35/045 417/363 |
| 6,884,044 | B2 * | 4/2005 | Lilie | F04B 35/045 417/363 |
| 7,153,108 | B2 | 12/2006 | Puff et al. | |
| 7,163,384 | B2 * | 1/2007 | Lilie | F04B 35/045 267/179 |
| 7,478,539 | B2 | 1/2009 | Shapiro et al. | |
| 2008/0089796 | A1 * | 4/2008 | Schade | F04B 35/045 417/417 |
| 2008/0118375 | A1 | 5/2008 | Muth et al. | |
| 2008/0134833 | A1 * | 6/2008 | Lilie | F04B 35/045 74/581 |
| 2009/0202373 | A1 | 8/2009 | Williams et al. | |

* cited by examiner

LINEAR COMPRESSOR

CROSS-REFERENCE TO RELATED APPLICATIONS

This application is a continuation-in-part of U.S. patent application Ser. No. 13/382,440 filed Mar. 22, 2012, which is the U.S. national phase of PCT/BR2010/000224, filed Jul. 6, 2010, which claims priority of Brazil Application PI 0902557-0, filed Jul. 8, 2009, which is incorporated herein by reference.

FIELD OF THE INVENTION

The present invention refers to a construction for a linear compressor and, more particularly, to a mounting arrangement for a linear compressor of the type generally used in small refrigeration systems, which allows distributing the forces transmitted from the compressor components to the shell to which the compressor is mounted. The present compressor can be constructed to be used not only in refrigeration systems of refrigeration appliances in general, but also for refrigerating the components of compact electronic appliances or other applications that require miniaturization of the compressor unit.

PRIOR ART

Linear compressors are known to be applied in refrigeration systems, and their construction has been object of researches generally aiming to improve the efficiency thereof. The linear compressor is basically a high vibration machine comprising a piston which is axially displaced in the interior of a compression chamber, in order to compress a determined mass of refrigerant gas of the refrigeration system during a refrigeration cycle of this system.

In the construction illustrated and described in Patent Application WO07/118295 of the same applicant, it is presented a compact compressor of the type to be particularly, but not exclusively, utilized to refrigerate electronic systems, said compressor generically comprising a generally hermetic shell 10 presenting a typical cylindrical shape; a cylinder 20, affixed to the shell 10 and defining a compression chamber 21 in the interior of which a piston 30 is axially displaced, in a reciprocating movement, during the operation of the compressor; a linear electric motor 40 mounted to the shell 10; an actuating means 50 operatively coupling the piston 30 to the linear electric motor 40, so as to make the latter displace the piston 30 in a reciprocating movement inside the compression chamber 21, said actuating means 50 being coupled to the piston 30 by means of a coupling means 60, in the form of an elastic means 60*a*, designed so that the actuating means 50 and the piston 30 are displaced in phase opposition during the operation of the compressor, as exposed hereinafter.

This embodiment requires a slide bearing M to guide the movable part of the motor in the interior of the shell during the compressor operation, preventing lateral movements of said movable part of the motor from unbalancing the compressor unit. However, this type of bearing generates friction and presents a limited lifetime as a function of its wear, since the compressors of the type considered herein are designed not to use oil for lubricating parts in relative movement. Another problem related to the use of slide bearings is the generation of noise; the bearing can generate noise in cases in which contact occurs between the movable parts.

Considering the reduced dimensions available in compact compressors, particularly for application in refrigeration systems of electronic appliances, it is desirable to provide a constructive solution which guarantees miniaturizing the compressor unit and, preferably, suppressing the slide bearings, minimizing the existence of parts with relative movement and in contact with each other in the compressor, and simplifying the construction thereof, without compromising the limitations established for dimensioning the linear compressor.

SUMMARY OF THE INVENTION

As a function of the drawback commented above and other disadvantages of the known constructive solutions, it is one of the objects of the present invention to provide a linear compressor which allows minimizing or even annulling the effects of the lateral loads actuating on the reciprocating parts of the compressor in the interior of the shell thereof, preventing the movable components of the compressor unit, particularly the assembly formed by the actuating means and by the movable part of the motor, from colliding with the compressor shell, without using slide bearings or other means that can cause contact between the movable parts of the compressor.

Another object of the present invention is to provide a compressor as cited above and which does not generate noise during its operation.

Another object of the present invention is to provide a compressor as cited above and which allows, in a simple manner, the construction of a compact linear compressor (of the type disclosed in WO07/118295) which annuls, at least in part, the effects of the lateral loads actuating on the piston in the interior of the compression chamber, minimizing the friction between said parts.

A further object of the present invention is to provide a compressor as cited above and which permits, in a simple manner, the construction of a compact linear compressor, without requiring the use of lubricant oil between the parts with relative movement.

Another object of the present invention is to provide a linear compressor as cited above and whose construction permits maintaining the dimensions of the compressor shell, as well as the overall weight of the latter with reduced values.

The present invention refers to a linear compressor of the type which comprises: a shell which internally affixes a cylinder defining a compression chamber in whose interior a piston is provided; a linear electric motor having a fixed part affixed internally to the shell and a movable part reciprocating in relation to the fixed part; an actuating means affixed to the movable part of the linear electric motor, so as to be driven by said movable part in a reciprocating movement; a coupling means, coupling the actuating means to the piston, so that said actuating means and piston are displaced in a reciprocating movement during the compressor operation.

According to the invention, the compressor comprises a supporting elastic means connecting the actuating means to the shell and presenting a radial stiffness capable to support the lateral loads actuating on the assembly defined by the movable part of the linear electric motor and by the actuating means, so as to minimize axial misalignments between said fixed and movable parts of the linear electric motor, resulting from the effects of said lateral loads, said supporting elastic means presenting a minimum axial stiffness, so as to allow the desired displacement of the piston and of the actuating means.

According to the present invention, in which the coupling means is an elastic means which couples the actuating means to the piston, the supporting elastic means presents a minimum axial stiffness, so as to allow the piston and the actuating means to present a displacement in phase opposition.

According to another particular aspect of the present invention, in which the piston is coupled to the elastic means, the compressor comprises an additional supporting elastic means connecting the piston to the shell and presenting a radial stiffness capable to support the lateral loads actuating on the piston, so as to minimize axial misalignments of the piston in relation to the compression chamber, resulting from the effects of said lateral loads, said additional supporting elastic means presenting a minimum axial stiffness, so as to allow the desired displacement, in phase opposition, of the piston and of the actuating means.

In another aspect of the present invention, the compressor comprises an additional supporting elastic means connecting, to the shell, an end portion of the elastic means, adjacent to the piston and presenting a radial stiffness capable of supporting the lateral loads actuating on said end portion of the elastic means, so as to minimize axial misalignments of the end portion of the elastic means in relation to the compression chamber, resulting from the effects of said lateral loads, said additional supporting elastic means presenting a minimum axial stiffness, so as to allow the desired displacement, in phase opposition, of the piston and of the actuating means.

Still another aspect of the present invention is to provide a linear compressor as defined above and in which the piston is rigidly coupled to the elastic means, or said piston is coupled to the elastic means by an articulation means.

BRIEF DESCRIPTION OF THE DRAWINGS

The invention will be described below, with reference to the enclosed drawings, given by way of example of possible embodiments of the present invention and in which.

DISCLOSURE OF THE INVENTION

Figure 1:
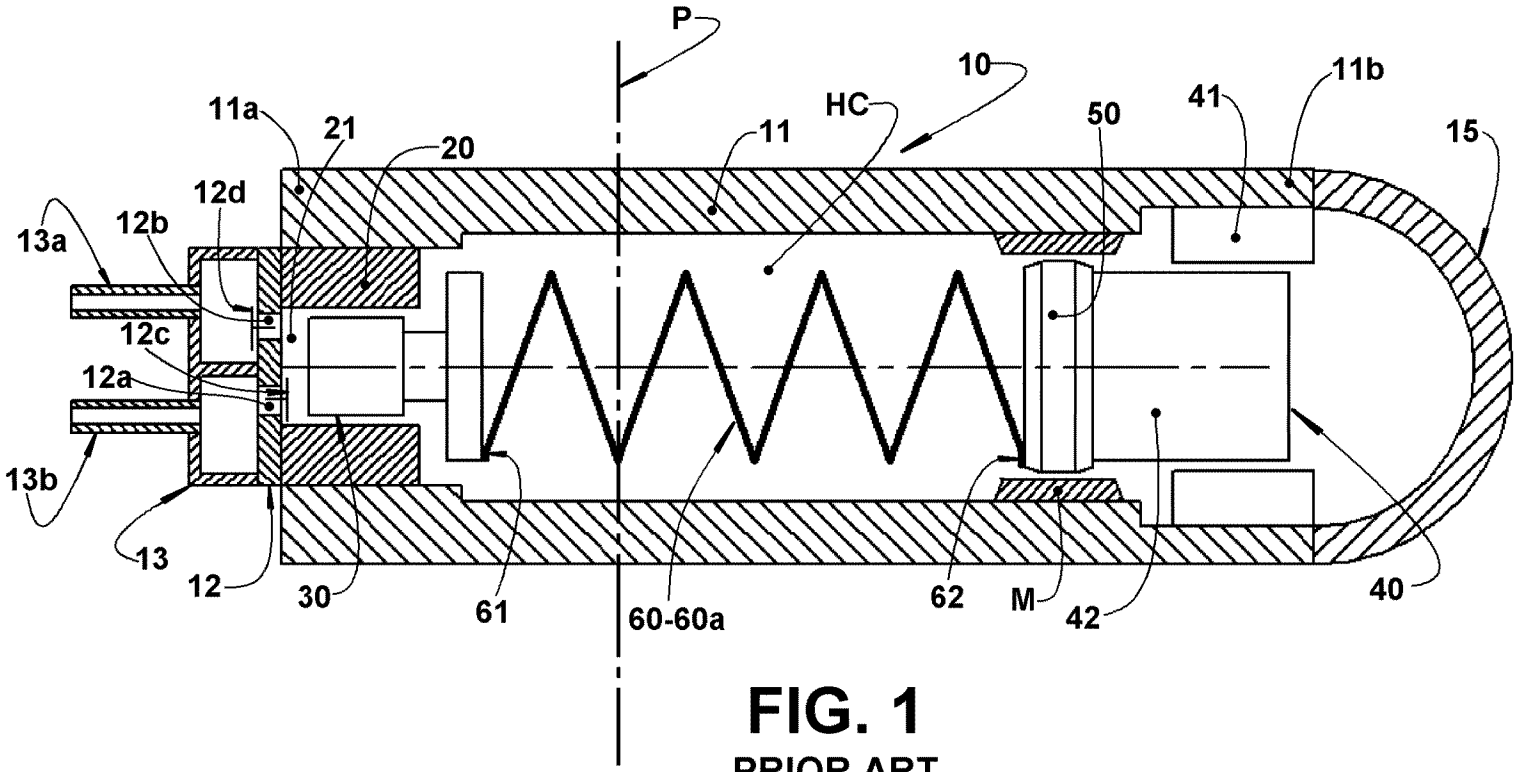
FIG. 1 PRIOR ART
FIG. 1 schematically represents a longitudinal sectional view of a construction of the linear compressor described and illustrated in WO07/118295.

As illustrated in FIGS. 1 to 5, 7 and 12, the present invention comprises a compressor for refrigeration systems, for example, a compact compressor of the type to be particularly, but not exclusively, utilized to refrigerate electronic systems, said compressor generally comprising a shell 10; a cylinder 20 internally affixed to the shell 10 and defining a compression chamber 21; a piston 30 reciprocating in the interior of the compression chamber 21 during the operation of the compressor; a linear electric motor 40 having a fixed part 41 internally affixed to the shell 10 and a movable part 42 reciprocating in relation to the fixed part 41; and an actuating means 50 affixed to the movable part 42 of the linear electric motor 40, so as to be driven by said movable part in a reciprocating movement.

The actuating means 50 is coupled to the piston 30 by a coupling means 60, so that said actuating means 50 and piston 30 are displaced, in a reciprocating movement during the operation of the compressor.

The piston 30, the actuating means 50, the movable part 42 of the linear electric motor 40 and the elastic means **60*a*** define a resonant movable assembly of the compressor.

In a particular compressor construction, such as that described in co-pending Patent Application WO07/118295 and to which the present invention is applied, the actuating means 50 is coupled to the piston 30 through a coupling means 60 in the form of an elastic means **60*a*, so that said actuating means 50 and piston 30** are displaced, in a reciprocating movement and in phase opposition, during the operation of the compressor.

In this construction, illustrated in the appended drawings and in which the piston 30 is not directly and rigidly affixed to the actuating means 50, but through an elastic means **60*a* (causing a reciprocating displacement that does not correspond to the reciprocating displacement of the actuating means 50), the reciprocating movement of the piston 40 is operatively associated with that movement determined for the actuating means 50 by the linear electric motor 40, allowing said piston 30 to present a displacement which is offset or in phase opposition, that is, in a direction opposite to that of the actuating means 50, which displacement may also present an amplitude different from that of the reciprocating displacement of the actuating means 50. This freedom of movement between the piston 30 and the actuating means 50 allows the relative reciprocating displacements to be previously defined, in order to annul the vibrations, in the direction of the reciprocating movement, caused by the displacement of each of said parts. In this type of construction, the displacement amplitudes of the piston 30 are smaller than those associated with the actuating means 50, as a function of the different masses of the two parts associated with the elastic means 60***a*.

The elastic means 60*a*, which operatively couples the piston 30 to the actuating means 50 in the illustrated constructions, is defined not only to guarantee the physical coupling between the parts of piston 40 and actuating means 50, but also to determine the transfer of movement from the linear electric motor 40 to the piston 30, in a determined amplitude, frequency and phase relation with the movement of the actuating means 50.

The elastic means 60*a* presents an axis coaxial to the displacement axis of the piston 30 and is dimensioned as a function of the masses of the piston 30 and of the actuating means 50, and of the desired displacement amplitudes that are predetermined for said parts of actuating means 50 and piston 30. The displacement amplitudes of both the piston 30 and the actuating means 50 are defined in relation to a transversal plane P, orthogonal to the axis of the elastic means 60*a*, defined at a predetermined distance in relation to a reference point contained in one of the parts of cylinder 20 and shell 10, said amplitudes being calculated to guarantee a determined power for the linear electric motor 50 and a determined gas pumping efficiency for the piston 30.

The elastic means 60*a*, coupled to the parts of piston 30 and actuating means 50, maintains stationary its region disposed on said transversal plane P, defining a point zero of the amplitude of the compressor operation, in which the vibration caused by the movement of each of the parts of piston 30 and actuating means 50 presents a null resultant, independent of the difference between the amplitudes being balanced.

The determination of the travel amplitude of both the piston 30 and the actuating means 50 is made by determining the masses and the spring constant of the elastic means 60*a*.

In the compressor constructions in which the travel of the piston 30 is not modified, the displacement amplitude of the actuating means 50 is defined so as to be greater than the displacement amplitude of the piston 30, allowing the desired power to be obtained with an electric motor of reduced dimensions, for example, of smaller diameter, but without the necessary increase of the travel of the actuating means 50 provoking alteration in the travel of the piston 30 and, consequently, in the pumping capacity thereof.

According to a constructive form of the compressor described herein and presented in WO07/11829, the actuating means 50 generally comprises a base portion defined by the movable part 42 of the linear electric motor 40, said base portion and load portion being preferably coaxial to one another and to the axis of the piston 30. In a way of carrying out the present invention, the base portion secures the load portion by a known conventional way, such as adhesive, threads, interference, etc, or incorporates said load portion in a single piece. The load portion (movable part 42 of the linear electric motor 40) carries permanent magnets (not illustrated) of the linear electric motor 40.

For the construction described herein, the elastic means 60*a* has an end affixed to the piston 30 and an opposite end affixed to the base portion of the actuating means 50. The elastic means 60*a* can be defined by one or two resonant helical springs with the same helical development direction and having their adjacent ends angularly spaced from each other.

The compressor described herein can comprise or not a positioning element (not illustrated) coupling the region of the elastic means 60*a*, situated on said transversal plane P, to one of the parts of cylinder 20 and shell 10.

For the present compressor construction, the elastic means 60*a* comprises at least one resonant cylindrical helical spring with an end coupled to the piston 30 and an opposite end coupled to the actuating means 50. In the constructions in which the elastic means 60*a* comprises more than two resonant helical springs, these present an angular distribution defining a plane of symmetry (for example with the same spacing) for the adjacent ends of said resonant helical springs.

In the construction illustrated in FIG. 1, the shell 10 presents, internally, a slide bearing M, which guarantees the alignment of the movable part 42 of the linear electric motor 40 during the operation of the compressor, but which presents the already previously discussed deficiencies.

According to the present invention, in which the slide bearing is not used anymore, the compressor comprises a supporting elastic means 70 connecting the actuating means 50 to the shell 10 and presenting a radial stiffness capable to support the lateral loads actuating on the assembly defined by the movable part 42 of the linear electric motor 40 and by the actuating means 50, so as to minimize axial misalignments between said movable part 42 and fixed part 41 of the linear electric motor 40, resulting from the effects of said lateral loads, said supporting elastic means 70 presenting a minimum axial stiffness, so as to allow the desired displacement, in phase opposition, of the piston 30 and the actuating means 50.

The compressor of the present invention can also comprise an additional supporting elastic means 80, coupling one of the parts of piston 30 and elastic means 60*a* to the shell 10, in the region in which said elastic means 60*a* is mounted to the piston 30.

The constructive forms and the degree of axial and radial stiffness of each of the parts of supporting elastic means 70 and additional supporting elastic means 80 may or may not be equal, the form and the degree of axial and radial stiffness of each of said supporting elastic means being defined as a function of the involved masses and the convenience of annulling the resultant of the forces that said supporting elastic means 70, 80 exert on the elastic means 60*a*.

The supporting elastic means 70 and the additional supporting elastic means 80 may be designed so that each present a respective axial stiffness defined so as to annul, jointly with the axial stiffness of the other of said elastic means, the axial forces on the shell 10 during reciprocation of the piston 30 and of the assembly formed by the actuating means 50 and the movable part 42 of the motor 40, upon operation of the compressor.

According to a way of carrying out the present invention, the supporting elastic means 70 is defined by at least one spring 71 disposed in a plane orthogonal to the axis of the fixed part 41 of the linear electric motor 40 connecting the actuating means 50 to the shell 10. This construction can be seen in FIGS. 2 and 3. In a variant of this solution, not illustrated, the supporting elastic means 70 comprises at least one spring 71 having part of its extension, for example that part to be affixed to the shell 10, disposed in a plane orthogonal to the axis of the fixed part 41 of the linear electric motor 40, the remainder of said spring 71 being disposed angularly to said axis of the fixed part 41 of the linear electric motor 40, defining a conical shape to said spring 71.

In the construction illustrated in FIGS. 2 to 6, the supporting elastic means 70 is defined by a single flat spring 71, for example comprising two concentric annular portions 72*a*, 72*b*, interconnected by a plurality of intermediary portions 73, in a spiral arrangement.

This embodiment of flat spring 71 is defined to present low axial stiffness and high radial stiffness. Moreover, it can be easily obtained, by cutting or stamping a flat metal sheet. Another advantage of this embodiment is its length in the axial direction. Since it is obtained from a metal sheet, the axial dimension is significantly reduced.

According to the illustrations, the shell 10 comprises an elongated tubular body 11, generally in metallic alloy and internally defining a hermetic chamber HC between the linear electric motor 40 and the cylinder 20, said hermetic chamber HC being open to a first end of the compression chamber 21 and lodging the actuating means 50 and the elastic means 60*a*.

A valve plate 12, of any known prior art construction, is seated and secured against a second end of the compression chamber 21, closing it.

A head 13 is externally seated and retained against the valve plate 12, providing selective fluid communications between the compression chamber 21 and the suction line 13*a* and discharge line 13*b* of a refrigeration circuit, not illustrated, to which the compressor is coupled.

According to the present invention, the head 13 (or also an end cover secured around at least part of the longitudinal extension of the adjacent shell portion surrounding the valve plate 12) is affixed, for example, through adhesives or mechanical interference, to the shell 10.

The valve plate 12, in which a suction orifice 12*a* and a discharge orifice 12*b* are defined selectively closed by a respective suction valve 12*c* and a respective discharge valve 12*d*, is seated against the second end of the compression chamber 21, closing said compression chamber 21, said second end of the compression chamber 21 being opposed to the one to which the piston 30 is mounted.

In the compressor construction presenting a shell 10, as illustrated in the enclosed drawings, said compressor presents the relatively moving parts thereof constructed to dispense the provision of lubricant oil for the compressor, as well as of a reservoir for said oil and means for pumping it to the parts with relative movement. The relatively moving parts of the compressor are made of a self-lubricant material, such as, for example, some plastics, or made of an antifriction material, or provided with a low friction wear-resistant coating.

In particular, the piston 30 can be produced in a self-lubricant material, such as, for example, some engineering plastics, or in conventional materials coated with low friction wear-resistant surface coating. The compression chamber 21, inside which occurs the displacement of the piston 30, may also receive a sleeve with a coating such as cited above.

Besides reducing the friction between the relatively moving parts, the determination of the material that forms the components of the compressor of the present invention considers balancing issues in the compressor. Within this concept, the compressor being described preferably presents its components made of a material with low mass density, in order to reduce the unbalancing forces coming from the reciprocating movement of the piston 30.

The compressor being described can be utilized in a wide range of rotations, for example from 3.000 rpm to 15.000 rpm, as a function of its characteristics.

Although the constructions illustrated herein present a fluid communication between the compression chamber 21 and the suction line through a head 13, it should be understood that the present invention can be also applied to compressor constructions, such as those described and illustrated in WO07/118295.

As illustrated, the elongated tubular body 11 of the shell 10 presents a first end 11*a*, to which the head 13 is affixed and a second end 11*b*, closed by a motor cover 15. In the prior art construction illustrated in FIG. 1, the linear electric motor 40 is mounted adjacent to the second end 11*b* of the elongated tubular body 11 of the shell 10.

It should be understood that, for any of the shell constructions described herein or also for those constructions presented in WO07/118295, at least one of the parts of shell 10 and motor cover 15 may also be externally provided with heat exchange fins, for refrigerating the present compressor during operation and for releasing, to the outside of the compressor, the heat that is generated by the motor and by compression of the refrigerant fluid in the compression chamber 21.

Figure 2:
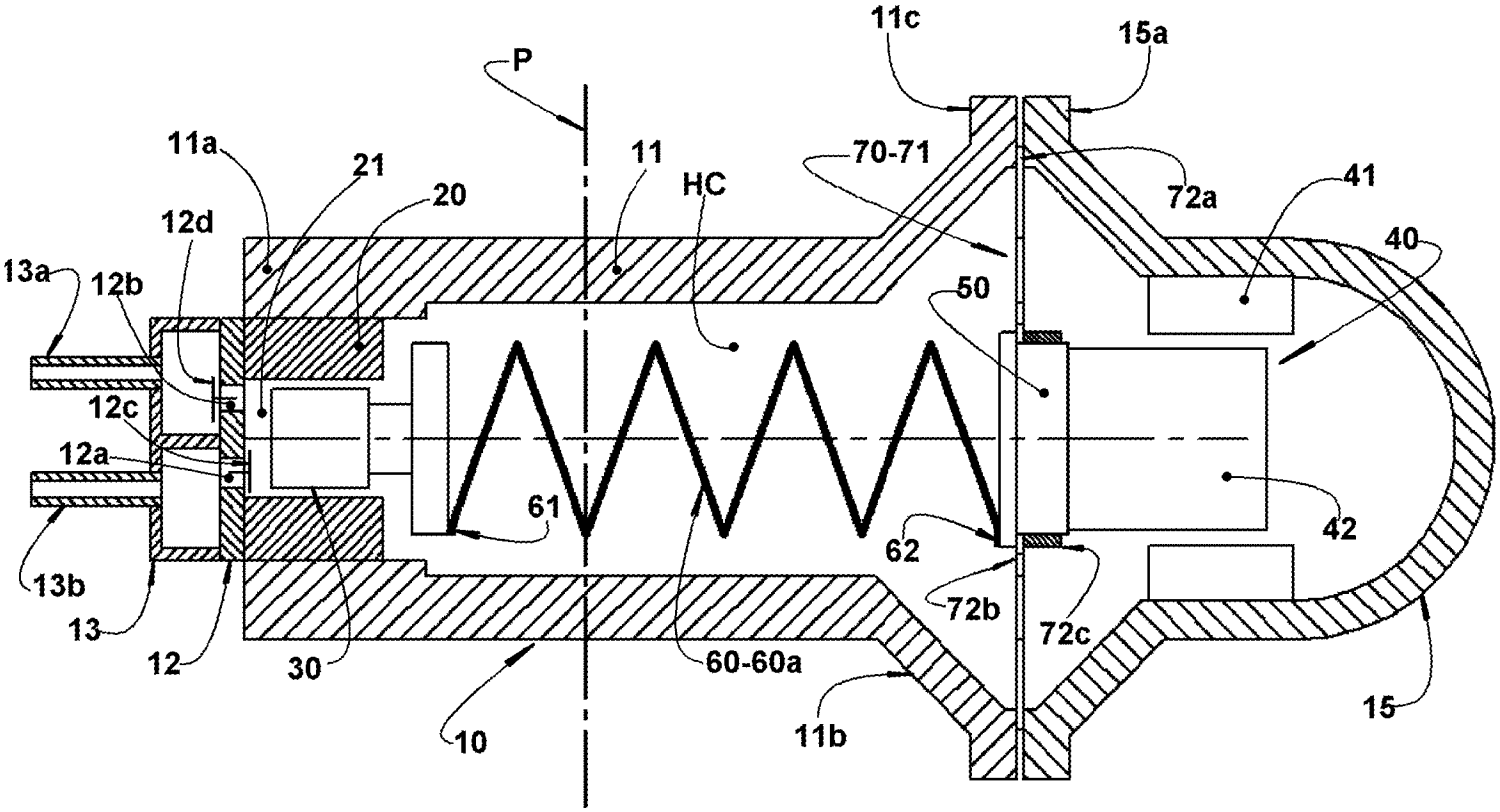
FIG. 2 represents, in a simplified and rather schematic way, a longitudinal sectional view of a compressor of the type illustrated in FIG. 1, but presenting a first embodiment of the present invention for the supporting elastic means.
Figure 3:
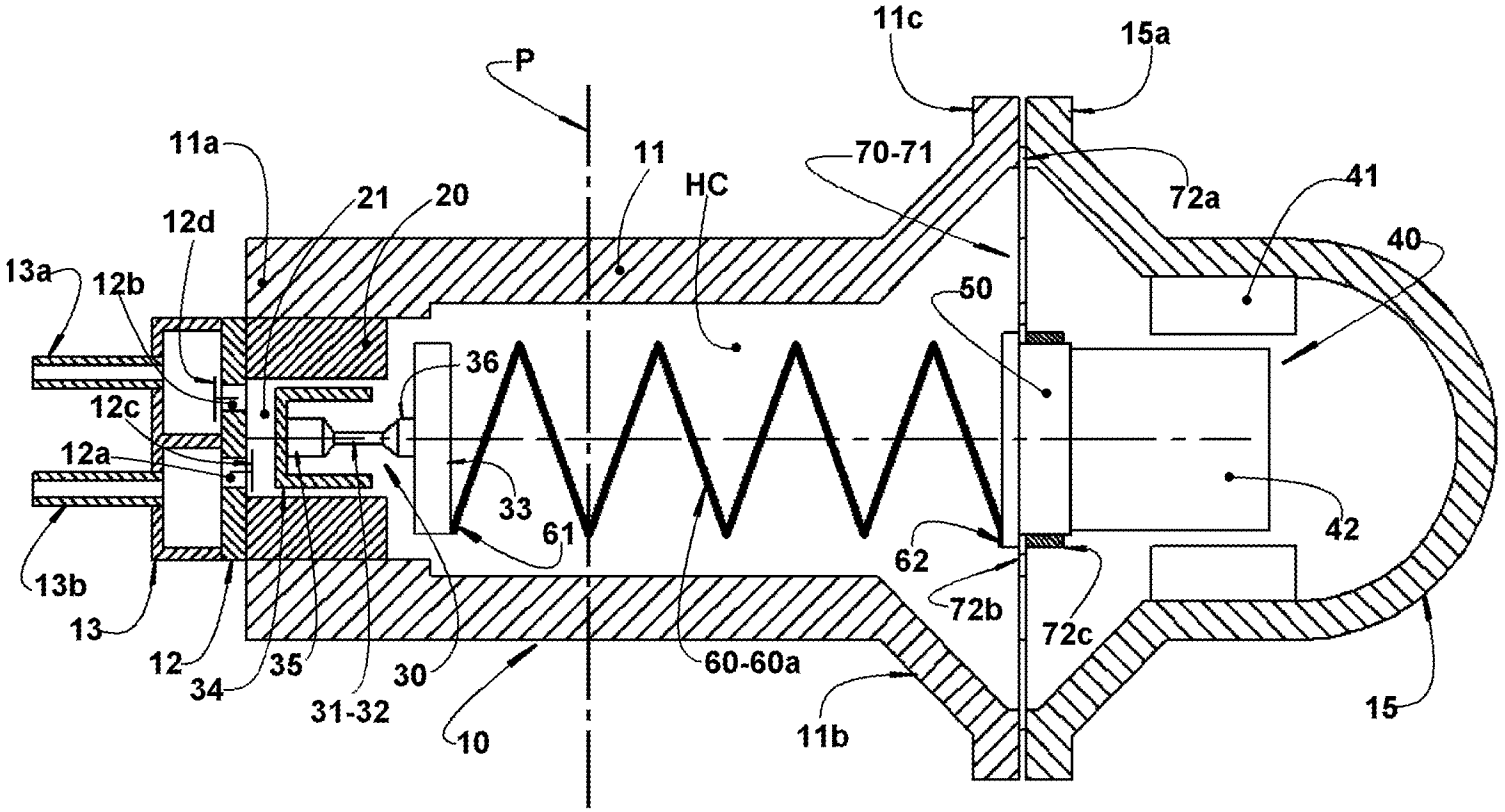
FIG. 3 schematically represents a constructive variant for mounting the piston to the elastic means, for the solution illustrated in FIG. 2, using an additional supporting elastic means.

According to a way of carrying out the present invention, as illustrated in FIGS. 2 and 3, the shell 10 is formed in at least two coaxial portions hermetically affixed to each other, one of which defining the elongated tubular body 11 of the shell 10 and, the other, the motor cover 15.

For the construction of the supporting elastic means 70 in the form of a flat spring 71, this presents a radially external portion defined by an outer annular portion 72*a*, affixed between said two shell portions.

In this construction, the second end 11*b* of the elongated tubular body 11 presents a peripheral flange 11*c* to be seated against a peripheral flange 15*a* of an open end portion of the motor cover 15, sandwiching a peripheral edge of the outermost annular portion 72*a* of the flat spring 71, which defines the supporting elastic means 70 in this construction, by appropriate means and using sealing joints to guarantee the hermeticity of the interior of the shell 10.

In the constructions illustrated in FIGS. 2 to 5, the innermost annular portion 72*b* of the flat spring 71, comprises a central hub 72*c* to be tightly mounted around an adjacent portion of the actuating means 50.

In these constructions, the shell 10 presents an enlargement in the fixation region of the motor cover 15, as a function of the diameter of the supporting elastic means 70.

The flat spring 71 illustrated in FIGS. 2 to 6 has its concentric annular portions 72*a*, 72*b* interconnected by a plurality of intermediary portions 73, in a spiral arrangement, defined between slots 75 produced in the same spiral development direction, said slots being dimensioned as a function of the stiffness desired for this construction of supporting elastic means 70.

According to another aspect of the present invention, to be applied in the constructions in which the piston 30 is directly coupled to the elastic means 60*a* (FIGS. 2 to 5), the present compressor comprises an additional supporting elastic means 80, connecting the piston 30 to the shell 10 wherein the additional supporting elastic means 80 is defined by at least one spring disposed in a plane orthogonal to an axis of the piston 30. The additional supporting elastic means 80 presents a radial stiffness capable to support the lateral loads actuating on the piston 30, so as to minimize axial misalignments of the piston 30 in relation to the compression chamber 21, resulting from the effects of said lateral loads, said additional supporting elastic means 80 presenting a minimum axial stiffness, so as to allow the desired displacement, in phase opposition, of the piston 30 and of the actuating means 50.

In this construction, the additional supporting elastic means 80 minimizes the occurrence, during the compressor operation, of impacts and friction between the piston 30 and the inner wall of the compression chamber 21.

Further according to the second aspect of the present invention, the additional supporting elastic means 80 connects, to the shell 10, an end portion 61 of the elastic means 60*a*, adjacent to the piston 30 and presents a radial stiffness capable to support the lateral loads actuating on said end portion 61 of the elastic means 60*a*, so as to minimize axial misalignments of the end portion 61 of the elastic means 60*a* in relation to the compression chamber 21, resulting from the effects of said lateral loads.

Figure 4:
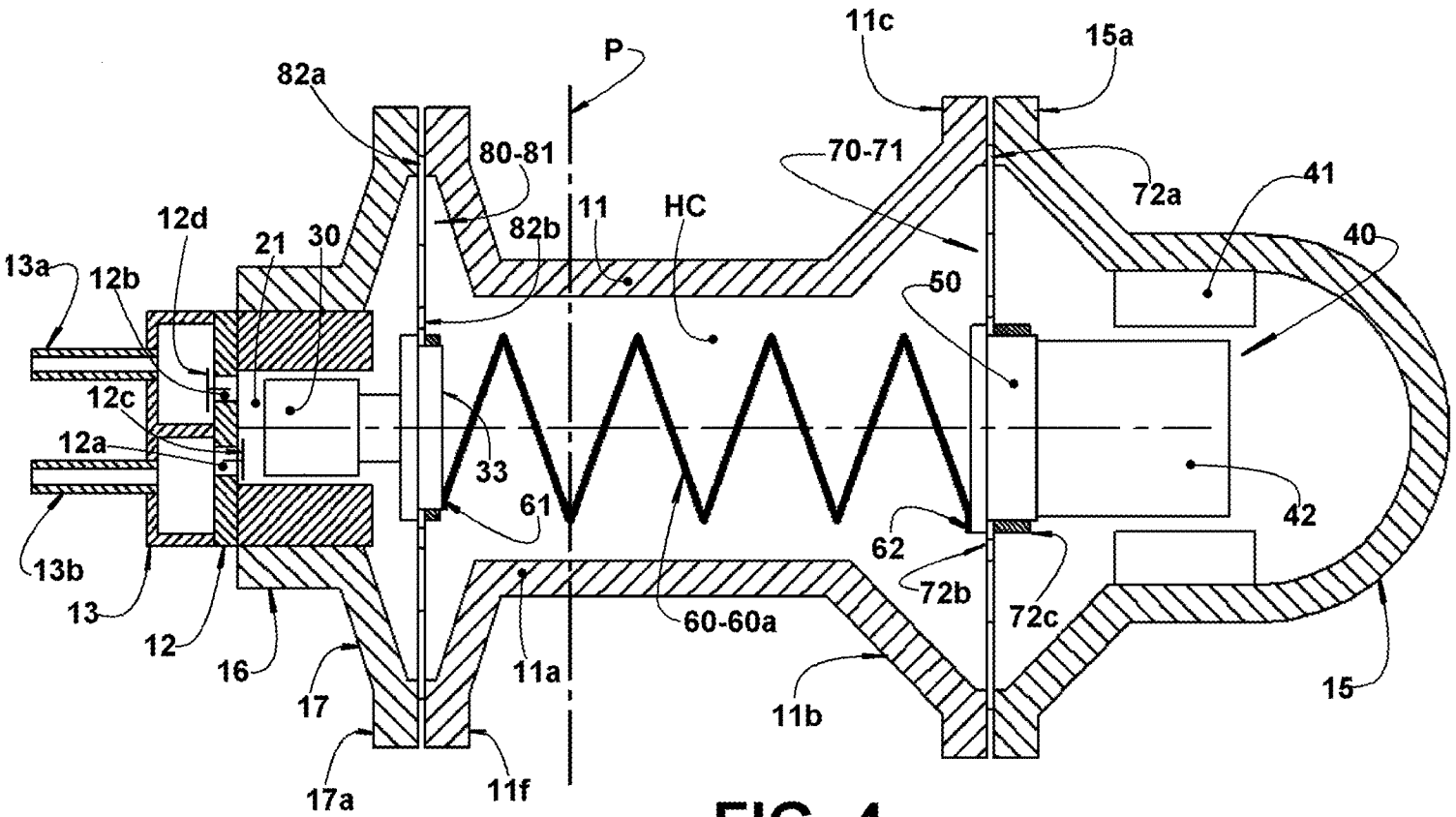
FIG. 4 schematically represents a view such as that of previous figures, for a second constructive option of the present invention.
Figure 5:
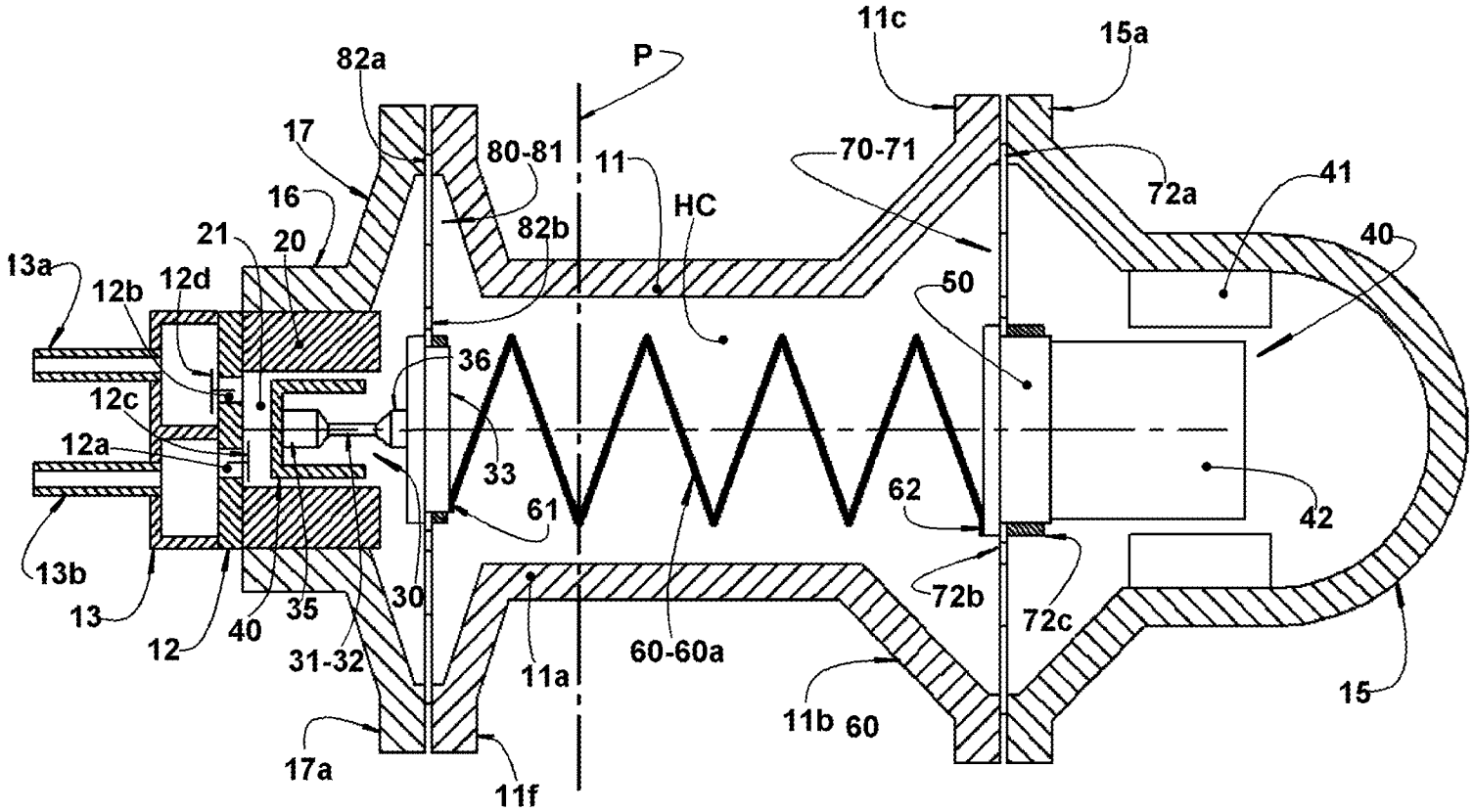
FIG. 5 schematically represents a constructive variant for mounting the piston to the elastic means, for the solution illustrated in FIG. 4.
Figure 6:
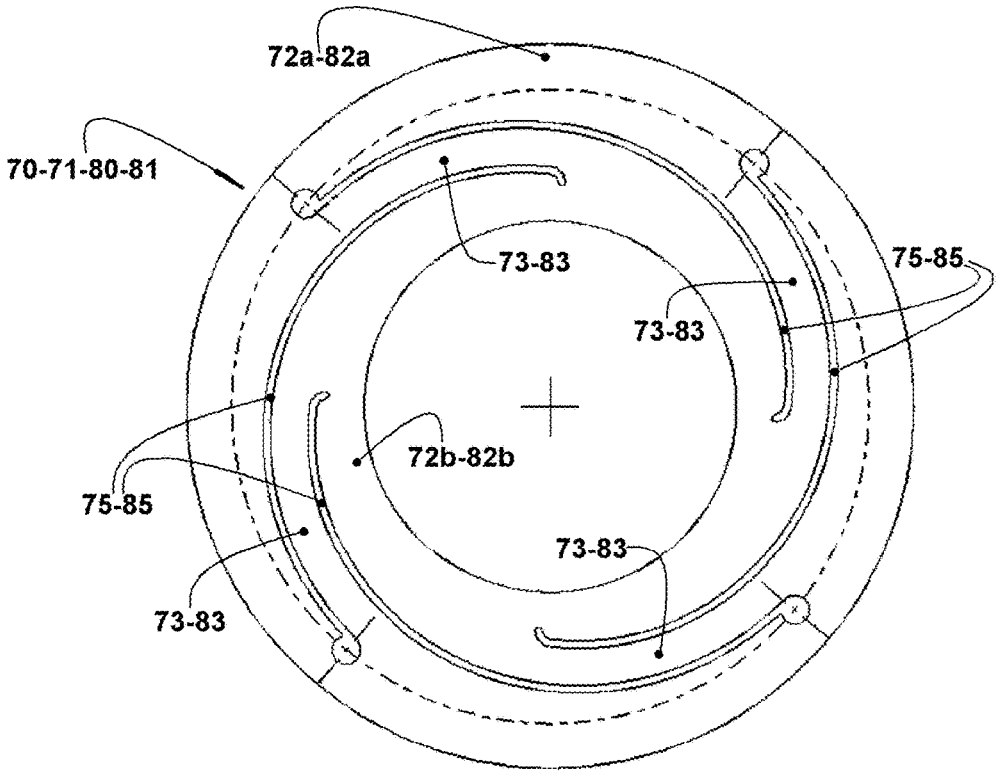
FIG. 6 schematically represents a constructive option for the supporting elastic means of the present invention, of the type illustrated in FIGS. 2 to 5.

As illustrated in FIGS. 4 and 5, in said second configuration of the invention, the additional supporting elastic means 80 is defined by an additional single flat spring 81. Considering the construction of the shell 10 as formed in at least two coaxial portions hermetically affixed to each other, said at least one spring defining the additional supporting elastic means 80 has a radially outer portion 82*a* affixed between two shell portions, as already disclosed in relation to a particular way to affix the supporting elastic means 70 to the shell 10.

As already discussed in relation to the supporting elastic means 70 in the form of a single flat spring 71, the additional single flat spring 81 of the additional supporting elastic means 80 also comprises two concentric annular portions 82*a*, 82*b* interconnected by a plurality of intermediary portions 83, in a spiral arrangement.

In the first and second configurations shown in FIGS. 2 and 3 and also in FIGS. 4 and 5, the piston 30 is directly coupled to the elastic means 60*a*. In the construction of FIGS. 2 and 4, the piston 30 is rigidly coupled to the elastic means 60*a*, and in FIGS. 3 and 5, the piston 30 is coupled to the elastic means 60*a* by an articulation means 31.

When the shell 10 presents three coaxial portions hermetically affixed to each other, as illustrated in FIGS. 4 and 5, two of which were already described and respectively defined by the elongated tubular body 11 and motor cover 15, and the other coaxial portion being defined by an end portion 16 to be mounted to the cylinder 20, said end portion 16 being provided with an enlarged peripheral edge 17 defining an end flange 17*a*, for the seating and mounting of a flange portion 11*f* of the first end 11*a* of the elongated tubular body 11 of the shell 10. The construction and mounting of this other flat spring 81 follows the same characteristics as that described for the flat spring 71, mounted to the actuating means 50, that is, said additional single flat spring 81 presents its outermost annular portion 82*a* affixed between the shell portions defined by the elongated tubular body 11 and peripheral edge 17 of the end portion 16.

In this construction of additional supporting elastic means 80, the shell 10 also presents an enlargement of its elongated tubular body 11, adjacent to its first end 11*a*, in the mounting region of the end portion 16.

Figure 7:
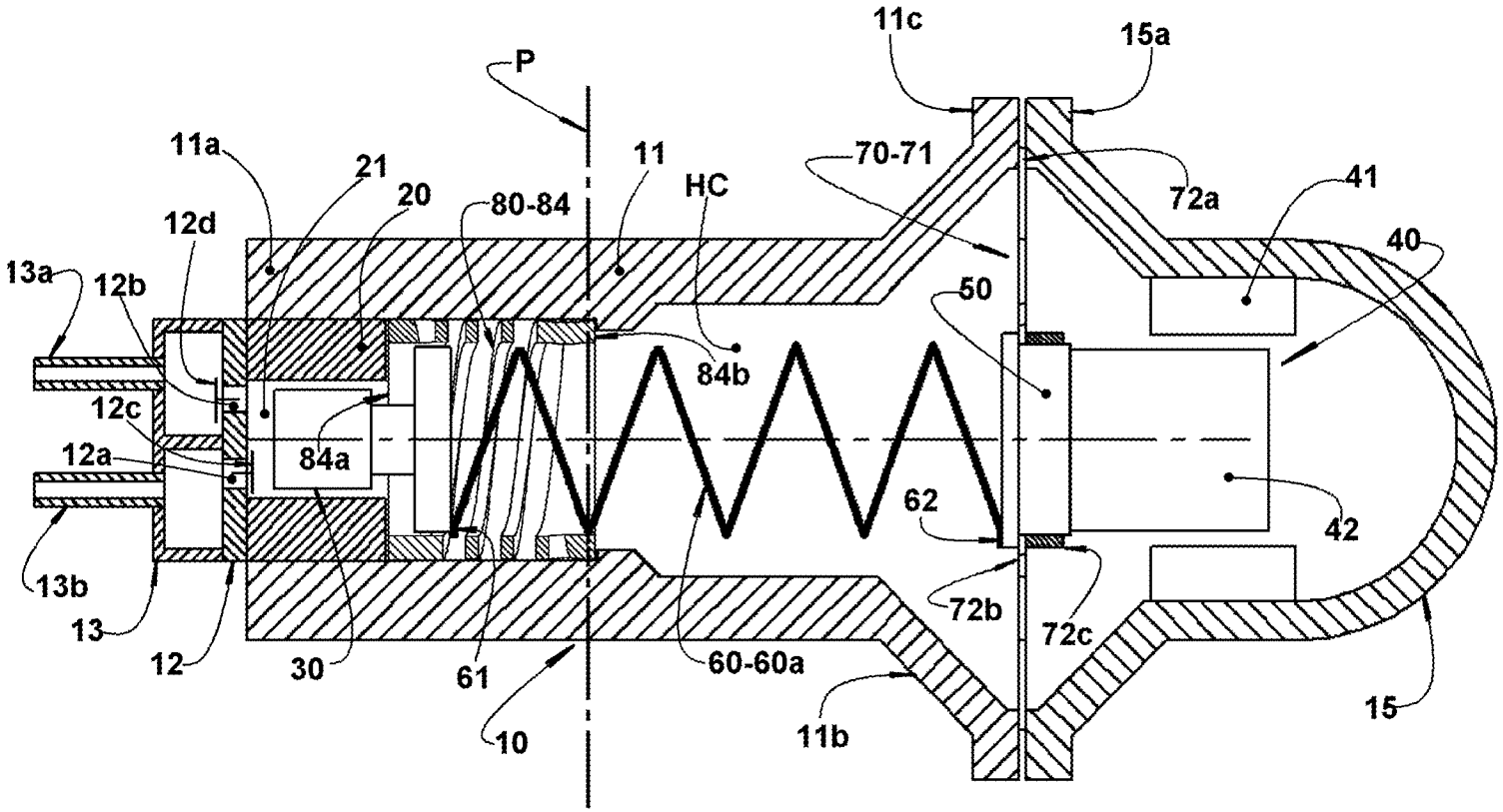
FIG. 7 schematically represents a view such as that of the previous FIGS. 2 to 5, for a third constructive option of the present invention, according to which the compressor is provided with a supporting means defined by a spring orthogonal to the axis of the electric motor of the compressor and with an additional supporting elastic means in the form of the cylindrical helical spring illustrated in FIG. 9.

In a third embodiment of the invention, illustrated in FIG. 7, the compressor includes a supporting elastic means 70 with a construction corresponding to that one already previously disclosed in relation to FIGS. 2 to 5 for connecting the actuating means 50 to the shell 10 and presenting the same construction and functional characteristics already disclosed for said supporting elastic means 70 including the particular construction in a single flat spring 71 comprising concentric annular portions 72*a*, 72*b* and which can be affixed to the shell 10 as already previously disclosed.

However in said third embodiment the compressor further includes an additional supporting elastic means 80 connecting the piston to the shell 10 and being defined by at least one additional cylindrical helical spring 84, which is coaxial to the axis of the piston 30 and having an end 84*a* coupled to the piston 30 and an opposite end 84*b* coupled to the shell 10. The additional cylindrical helical spring 84 connects the piston 30 to the shell 10 and presents a radial stiffness capable to support the lateral loads actuating on the piston 30, so as to minimize axial misalignments of the piston 30 in relation to the compression chamber 21, resulting from the effects of said lateral loads, said additional cylindrical helical spring 84 presenting a minimum axial stiffness, so as to allow the desired displacement, in phase opposition, of the piston 30 and of the actuating means 50.

Figure 9:
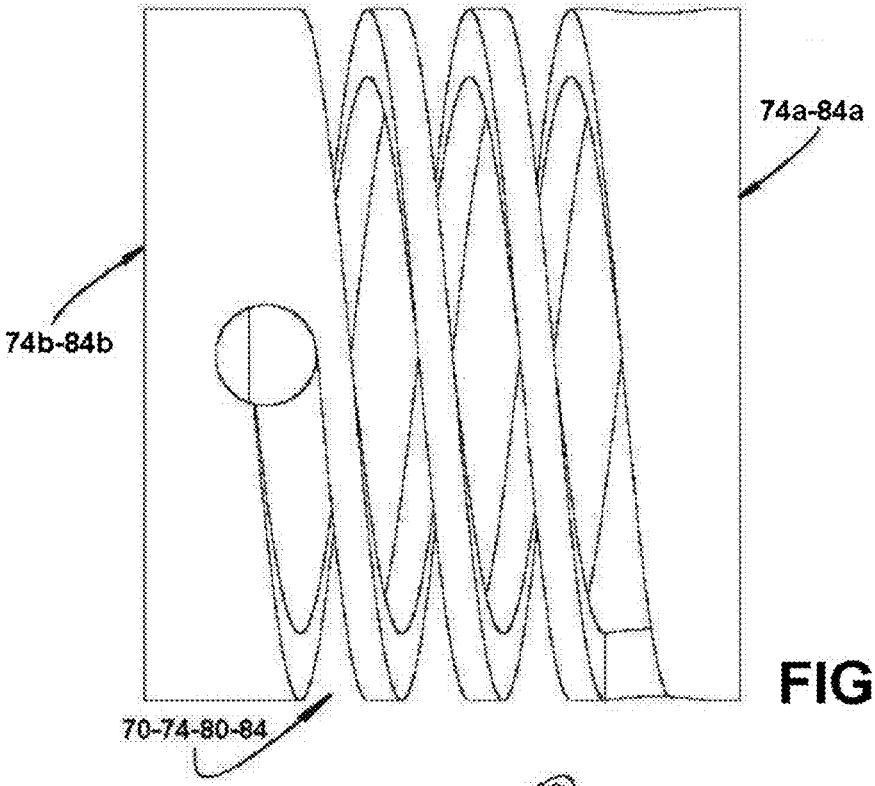
FIG. 9 schematically represents a lateral view of a possible construction for the supporting elastic means as a cylindrical helical spring.
Figure 10:
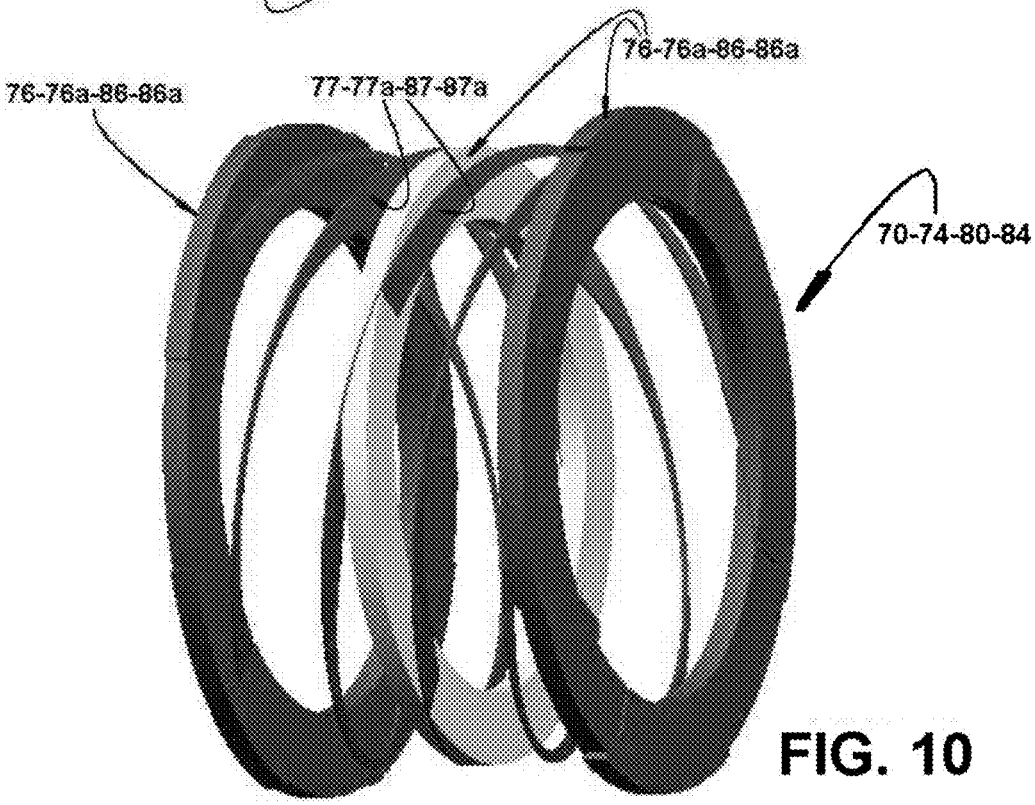
FIG. 10 schematically represents a perspective view of another possible construction for the supporting elastic means as a multiple cylindrical helical spring.

In the third construction illustrated in FIG. 7, the additional cylindrical helical spring 84 can surround an end region of the cylindrical helical spring 60 adjacent to the piston 30. Said additional cylindrical helical spring 84 can be constructed in different manners as illustrated in FIGS. 9 and 10. The construction of FIG. 9 is that one applied, for example, in FIG. 7, while the construction of FIG. 10 is that one applied, for example, to FIG. 7A.

As can be seen from FIG. 10, the additional cylindrical helical spring 84 can comprise coils 86 formed by three rings 86*a* coaxially aligned and affixed to each other through helical spring elements 87 defined by a plurality of strips 87*a* affixed to the rings 86*a*, the outer rings 86*a* being affixed to the shell 10 and the central ring 86*a* being movable and affixed to the actuating means 50.

Figure 8:
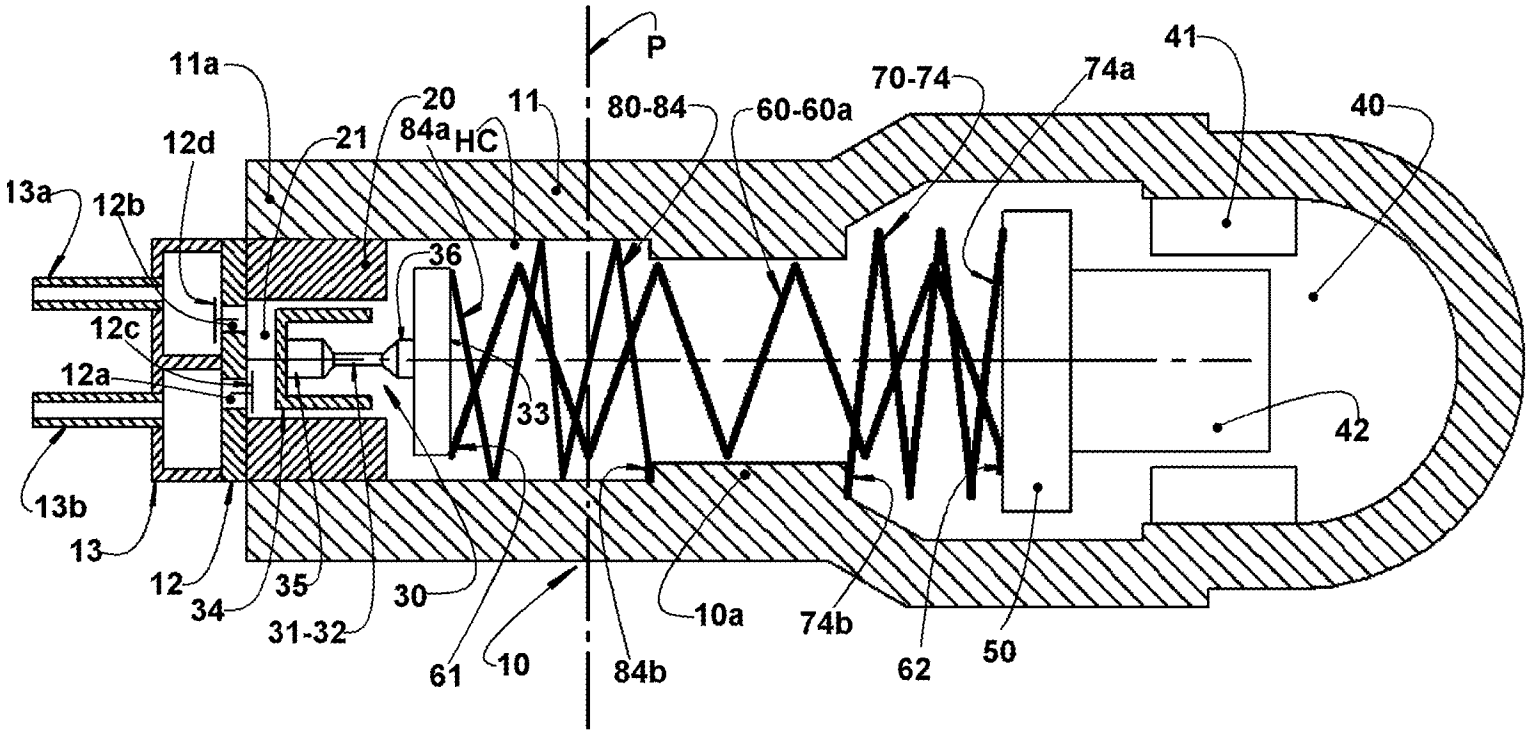
FIG. 8 schematically represents a view such as that of the previous FIG. 7, for a fourth constructive option of the present invention, according to which the compressor is provided with two supporting elastic means in the form of cylindrical helical springs.

In a fourth embodiment of the invention, illustrated in FIG. 8, the linear compressor comprises, as already discussed in relation to previous figures, a shell 10 affixing, internally, a cylinder 20 defining a compression chamber 21 in whose interior is provided a piston 30; a linear electric motor 40 having a fixed part 41 internally affixed to the shell 10 and a movable part 42 reciprocating in relation to the fixed part 41; an actuating means 50 affixed to said the movable part 42, to be driven thereby in a reciprocating movement; a cylindrical helical spring 60 coupling the actuating means 50 to the piston 30, so that said cylindrical helical spring 60, said actuating means 50 and said piston 30 are displaced, as a resonant movable assembly, in a reciprocating movement, during the operation of the compressor.

According to this fourth embodiment, the compressor further comprises a supporting elastic means 70 defined by at least one other cylindrical helical spring 74 which is coaxial to the axis of the fixed part 41 of the linear electric motor 40 and having an end 74*a* coupled to the actuated means 50, an opposite end 74*b* coupled to the shell 10, in order to connect the actuating means 50 to the shell 10, and presenting a radial stiffness capable to support the lateral loads actuating on the assembly defined by the movable part 42 of the linear electric motor 40 and by the actuating means 50, minimizing axial misalignments between said movable 42 and fixed 41 parts, resulting from the effects of said lateral loads, said supporting elastic means 70 presenting a minimum axial stiffness, so as to allow the desired displacement of the piston 30 and the actuating means 50.

Still according to the fourth embodiment of FIG. 8, the compressor further includes an additional supporting elastic means 80 connecting the piston 30 to the shell 10 and being defined by at least one additional cylindrical helical spring 84 which is coaxial to the axis of the piston 30 and having an end 84*a* coupled to the piston 30 and an opposite end 84*b* coupled to the shell 10, said additional cylindrical helical spring 84 connecting the piston 30 to the shell 10, said additional cylindrical helical spring 84 presenting a radial stiffness capable to support the lateral loads actuating on the piston 30, so as to minimize radial misalignments of the piston 30 in relation to the compression chamber 21, resulting from the effects of said lateral loads, said additional cylindrical helical spring 84 presenting a minimum axial stiffness, so as to allow the desired displacement, in phase opposition, of the piston 30 and of the actuating means 50.

In a preferred construction illustrated schematically in FIG. 8, the other cylindrical helical spring 74 and the additional cylindrical helical spring 84 surround respective end regions of the first cylindrical helical spring 60 adjacent to the actuating means 50 and adjacent to the piston 30.

As already commented in relation to the third embodiment, in the fourth construction illustrated in FIG. 8, the other and the additional cylindrical helical springs 74, 84 can surround an end region of the cylindrical helical spring 60 adjacent to the actuating means 50 and to the piston 30, respectively. Said other and additional cylindrical helical springs 74, 84 can be constructed in different manners as illustrated in FIGS. 9 and 10.

As can be seen from FIG. 10, the additional cylindrical helical spring 84 can comprise coils 86 formed by three rings 86*a* coaxially aligned and affixed to each other through helical spring elements 87 defined by a plurality of strips 87*a* affixed to the rings 86*a*, the outer rings 86*a* being affixed to the shell 10 and the central ring 86*a* being movable and affixed to the actuating means 50.

Figure 7A:
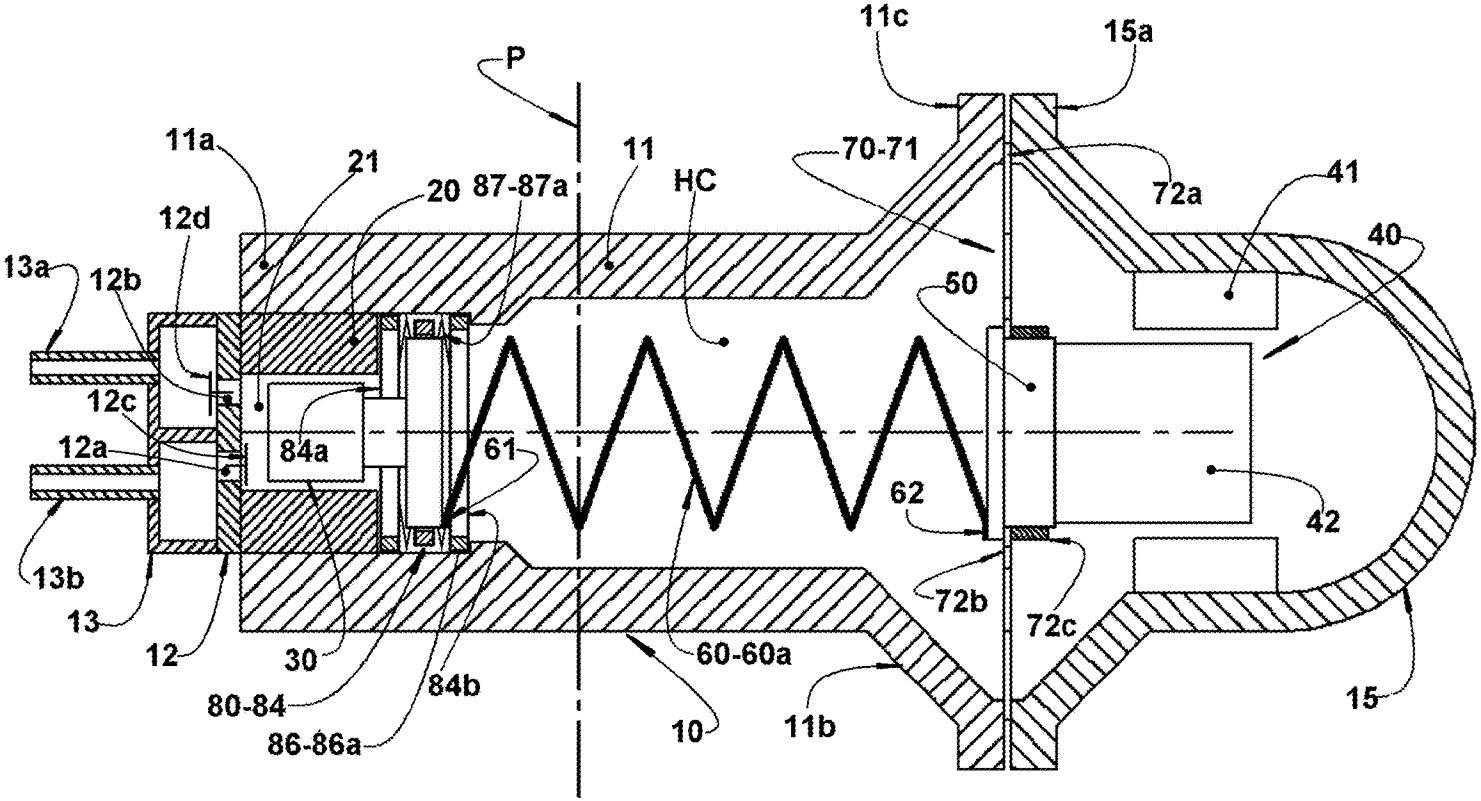
FIG. 7A represents a view similar to that of FIG. 7, but with the additional supporting elastic means in the form of the cylindrical helical spring illustrated in FIG. 10.

The manner by which the other and additional cylindrical helical springs 74, 84 illustrated in FIGS. 9 and 10 can be mounted in both ends of the resonant cylindrical helical spring 60 can be the same as illustrated in FIGS. 7 and 7A.

As illustrated in FIG. 10, any of the other and the additional cylindrical helical springs 74, 84 can comprise coils 76, 86 formed by three rings 76*a*, 86*a* coaxially aligned and affixed to each other through helical spring elements 77, 87 defined by a plurality of strips 77*a*, 87*a* affixed to the rings 76*a*, 86*a*, the outer rings 76*a*, 86*a* being affixed to the shell 10 and the central ring 76*a*, 86*a*) of both the other and the additional cylindrical helical springs 74, 84 being movable and affixed, respectively, to the actuating means 50 and to the piston 30.

Figure 11:
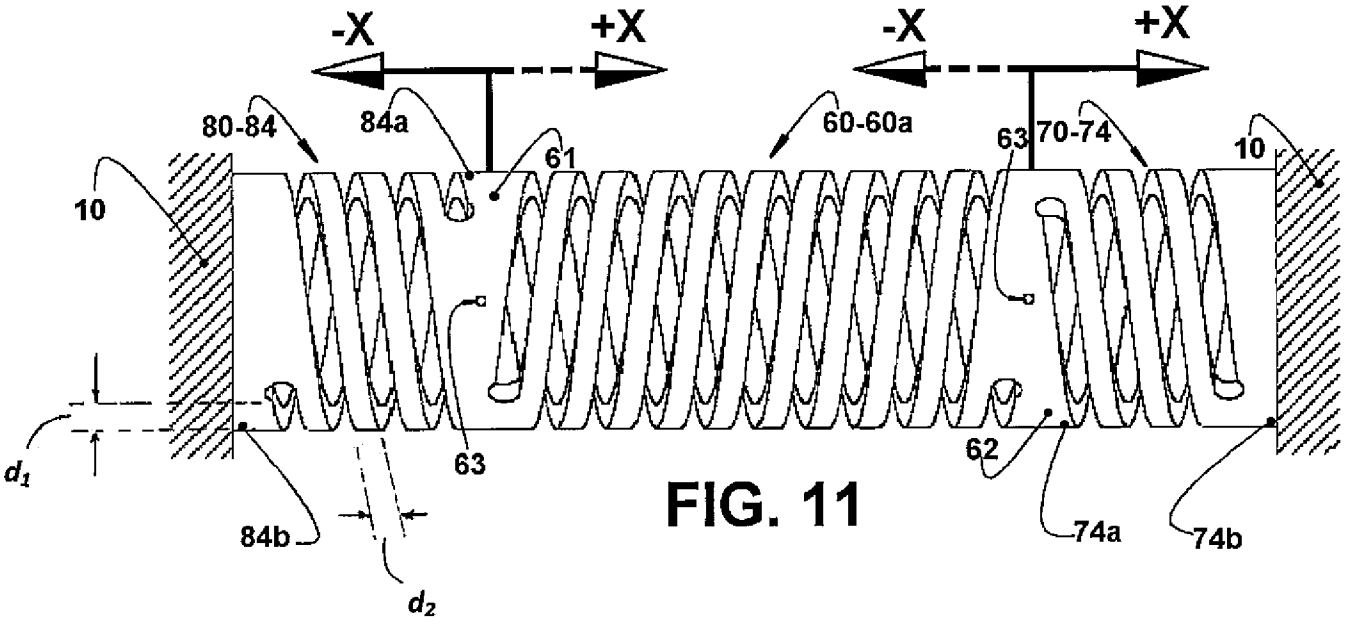
FIG. 11 schematically represents a lateral view of another possible construction for the supporting elastic means in a single piece with the resonant cylindrical helical spring indicating, in continuous lines, an expansion condition of the supporting elastic means and, in dashed lines, a compression condition of the latter.
Figure 12:
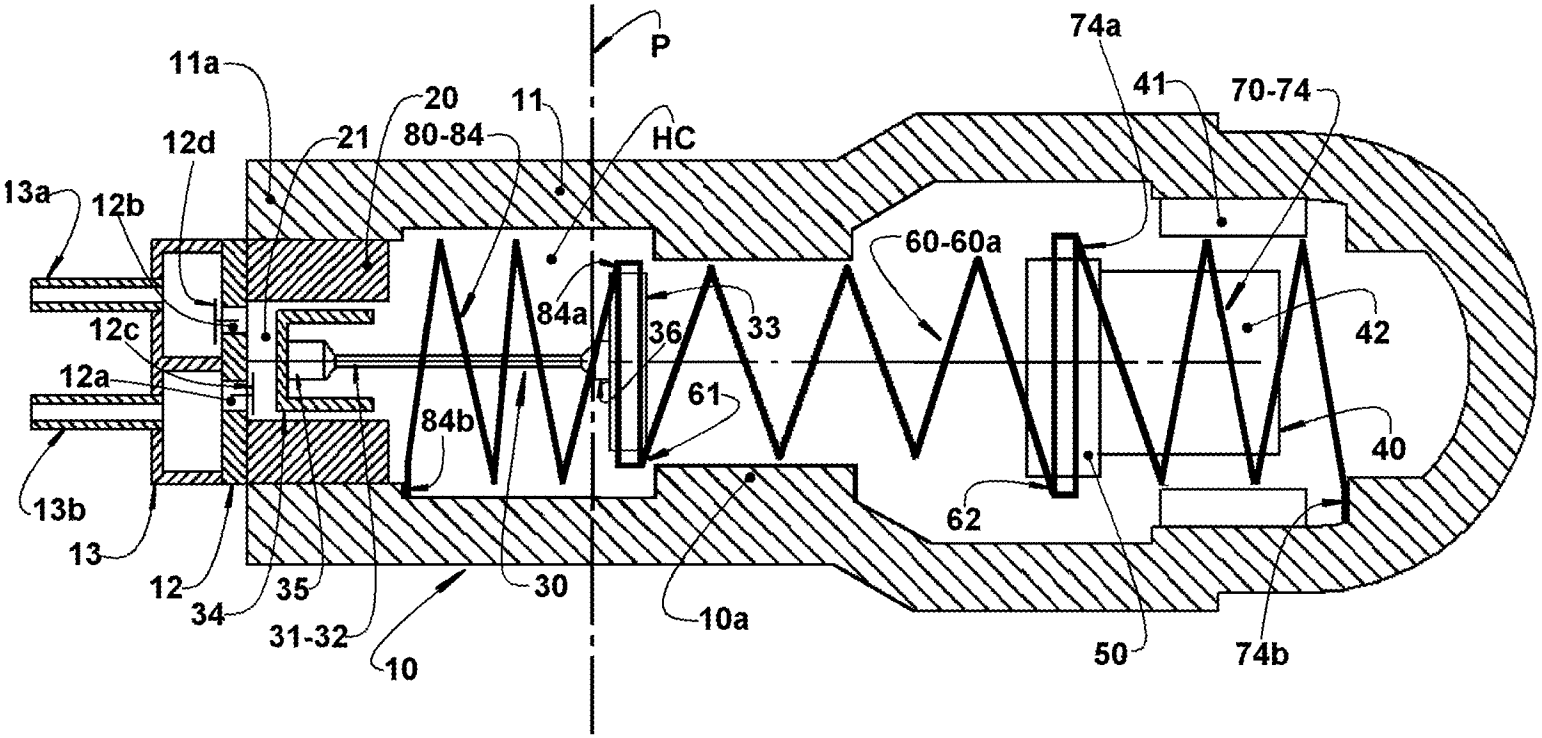
FIG. 12 schematically represents a view similar to that of FIG. 8, but illustrating both supporting elastic means and the resonant cylindrical helical spring formed in a single piece as shown in FIG. 11.

In relation to the fourth embodiment of the invention, it is possible, as shown in FIGS. 11 and 12, that at least one of the other and the additional cylindrical helical springs 74, 84 is obtained in a single piece with the cylindrical helical spring 60, 60*a* and defining a respective spring extension from one of the parts defined by the end portion 61 and by the opposite end portion 62 of the cylindrical helical spring 60, 60*a*, the at least one of the other and the additional cylindrical helical springs 74, 84, having one end 74*a*, 84*a*, coupled to the actuator 50 and to the piston 30, respectively and an opposite end 74*b*, 84*b*, coupled to the shell 10, as schematically illustrated in FIG. 12. According to this construction (see FIGS. 11 and 12), the end 74*a* of the other cylindrical helical spring 74 is connected to the opposite end portion 62 of the cylindrical helical spring 60 and also to the actuator 50, while the end 84*a* of the additional cylindrical helical spring 84 is connected to the end portion 61 of the cylindrical helical spring 60 and also to the piston 30.

In the illustrated construction of FIGS. 11 and 12, in each end portion 61 and opposite end portion 62, the cylindrical helical spring 60 is provided with a hole 63 for affixing the two supporting elastic means 70, 80, to the actuator 50 and to the piston 30, respectively.

Due to this connection to the elastic means 60*a*, the two supporting elastic means 70, 80, in the construction discussed just above, are also submitted to the operational movement of the elastic means 60*a*. In order to prevent such two supporting elastic means 70, 80, from interfering in the operation of the elastic means 60*a*, the axial stiffness thereof is calculated considering the axial stiffness of each said supporting elastic means 70, 80. The supporting elastic means 70, 80, are constructed to present a spring wire with a reduced thickness in the axial direction and a larger thickness in the radial direction, in order to allow obtaining the desired operational behavior for said supporting elastic means. The thickness in the radial direction, as indicated by $d_1$, is substantially greater than the thickness in the axial direction, as indicated by $d_2$. It should be understood that the radial stiffness and the axial stiffness of the supporting elastic means 70 and of the additional supporting elastic means 80 are defined as a function of the loads to which the supporting elastic means 70 or the additional supporting elastic means 80 will be submitted during the compressor operation.

The provision of the articulation means 31 allows preventing that deviations of the elastic means 60*a* in relation to the piston 30 are transmitted to the latter, which deviations are caused by radial vibrations, resulting from the compression and suction operations of the compressor, and also by possible mounting misalignments (imperfections) of the additional supporting elastic means 80.

In the construction illustrated in FIGS. 3, 5 and 7, the articulation means 31 includes a rod 32 connecting a base portion 33 to a top portion 34 of the piston 30, responsible for the gas compression in the compression chamber 21, said rod 32 being connected between the base portion 33 and the top portion 34 through respective articulations 35, 36, such as, for example, a ball-joint means or an articulated engaging means.

The axial stiffness of the construction presenting the supporting elastic means 70 and the additional supporting elastic means 80 is used to balance the vibration of the compressor. Since the piston 30 and the linear electric motor 40 move coaxially and in opposite directions to each other, the reaction force of one of the supporting elastic means 70 and additional supporting elastic means 80 against the shell 10 of the compressor is nullified by the other of said supporting elastic means 70 and additional supporting elastic means 80 which is operating in the opposite direction. For this neutralization of forces, it is necessary that the product of stiffness X travel of the supporting elastic means (or additional supporting elastic means) be equal for the two supporting elastic means in operation.

The use of the two supporting elastic means can affect the main resonant system of the compressor with the additional stiffness in the ends of said two supporting elastic means. This interference must be limited in order not to interfere in the transfer of energy from the motor to the piston.

The two supporting elastic means described herein can be employed only to support the mechanism at the side of the linear electric motor 40 (supporting elastic means 70), or they can also be employed at the side of the piston 30 (additional supporting elastic means 80) suspending the whole mechanism through springs.

The construction of articulated piston 30 can be used jointly with the two supporting elastic means described herein, in order to prevent mounting misalignments from generating undesired forces on the piston 30.

The advantage of using supporting elastic means is the low energy loss thereof, as it occurs only in a very small degree upon deformation of the spring structure. Since there is no friction between the components, it is not necessary to use oil for operation thereof, which fact, besides the ecological aspect involved, imparts versatility to the compressor application, by allowing said compressor to operate in any position.

The invention claimed is:

1. A linear compressor comprising a shell (10) affixing, internally, a cylinder (20) defining a compression chamber (21) in whose interior is provided a piston (30); a linear electric motor (40) having a fixed part (41) internally affixed to the shell (10) and a movable part (42) reciprocating in relation to the fixed part (41); an actuator (50) affixed to the movable part (42), to be driven thereby in a reciprocating movement; a cylindrical helical spring (60) coupling the actuator (50) to the piston (30), so that said cylindrical helical spring (60), said actuator (50) and said piston (30) are displaced, as a resonant movable assembly in phase opposition, in a reciprocating movement, during the operation of the compressor; an elastic support (74) defined by at least one other cylindrical helical spring (74) which is coaxial to a longitudinal axis of the fixed part (41) of the linear electric motor (40) and having an end (74*a*) coupled to the actuator (50), an opposite end (74*b*) coupled to the shell (10), in order to connect the actuator (50) to the shell (10), the compressor further including an additional elastic support (84) connecting the piston (30) to the shell (10) and being defined by at least one additional cylindrical helical spring (84) which is coaxial to a longitudinal axis of the piston (30) and having an end (84*a*) coupled to the piston (30) and an opposite end (84*b*) coupled to the shell (10), said additional cylindrical helical spring (84) connecting the piston (30) to the shell (10), characterized in that both the other and the additional cylindrical helical springs (74, 84) are obtained in a single piece with the cylindrical helical spring (60, 60*a*) such that the other and the additional cylindrical helical springs (74, 84) define respective spring extensions extending from the cylindrical helical spring (60, 60*a*), wherein the additional cylindrical helical spring (84) extends from an end portion (61) of the cylindrical helical spring (60, 60*a*) and the other cylindrical helical spring (74) extends from an opposite end portion (62) of the cylindrical helical spring (60, 60*a*), the other cylindrical helical spring (74) having an end (74*a*) coupled to the actuator (50) and an opposite end (74*b*) coupled to the shell (10), the additional cylindrical helical spring (84) having an end (84*a*) coupled to the piston (30) and an opposite end (84*b*) coupled to the shell (10), the end (74*a*) of the other cylindrical helical spring (74) being obtained in a single piece with the opposite end portion (62) of the cylindrical helical spring (60) and also being connected to the actuator (50), while the end (84*a*) of the additional cylindrical helical spring (84) is obtained in a single piece with the end portion (61) of the cylindrical helical spring (60) and also is connected to the piston (30), said elastic support (74) presenting a spring wire with a reduced thickness in the axial direction of the elastic support (74) and a larger thickness in the radial direction of the elastic support (74), proportionally one in relation to the other, for guiding the motor (40), and said additional elastic support (84) presenting a spring wire with a reduced thickness in the axial direction of the additional elastic support (84) and a larger thickness in the radial direction of the additional elastic support (84), proportionally one in relation to the other, for guiding the piston (30).

* * * * *